US009777360B2

(12) United States Patent
Wüst et al.

(10) Patent No.: US 9,777,360 B2
(45) Date of Patent: Oct. 3, 2017

(54) METHOD FOR HEAT-TREATING A CAST COMPONENT

(75) Inventors: Jürgen Wüst, Erding (DE); Dirk E. O. Westerheide, Versmold (DE)

(73) Assignee: MAGNA BDW Technologies GmbH, Markt Schwaben (DE)

( * ) Notice: Subject to any disclaimer, the term of this patent is extended or adjusted under 35 U.S.C. 154(b) by 578 days.

(21) Appl. No.: 13/811,323

(22) PCT Filed: Jul. 20, 2011

(86) PCT No.: PCT/EP2011/062471

§ 371 (c)(1),
(2), (4) Date: Apr. 1, 2013

(87) PCT Pub. No.: WO2012/022577

PCT Pub. Date: Feb. 23, 2012

(65) Prior Publication Data

US 2013/0269843 A1 Oct. 17, 2013

(30) Foreign Application Priority Data

Jul. 21, 2010 (DE) ..... 10 2010 031 612
Nov. 24, 2010 (DE) ..... 10 2010 061 895

(51) Int. Cl.

| | |
|---|---|
| ***C22F 1/00*** | (2006.01) |
| ***C21D 1/60*** | (2006.01) |
| ***C21D 1/607*** | (2006.01) |
| ***C22F 1/04*** | (2006.01) |

(52) U.S. Cl.

CPC ..... *C22F 1/002* (2013.01); *C21D 1/60* (2013.01); *C21D 1/607* (2013.01); *C22F 1/04* (2013.01)

(58) Field of Classification Search

CPC ..... C22F 1/04
USPC ..... 148/698–702
See application file for complete search history.

(56) References Cited

U.S. PATENT DOCUMENTS

| | | | | |
|---|---|---|---|---|
| 4,420,345 | A | 12/1983 | Ito et al. | |
| 4,488,913 | A | 12/1984 | Ferton | |
| 6,387,195 | B1 * | 5/2002 | Bishop et al. | 148/660 |

FOREIGN PATENT DOCUMENTS

| | | | |
|---|---|---|---|
| DE | 2810958 | A1 | 7/1979 |
| EP | 0051549 | A1 | 5/1982 |
| WO | 0236842 | A2 | 5/2002 |

OTHER PUBLICATIONS

J.R. Keough, Salt Quenching, Steel Heat Treating Fundamentals and Processes. vol. 4A, ASM Handbook, ASM International, 2013, p. 232-237.*

Chinese Patent Application No. 201180045560.3 Search Report, dated Jun. 5, 2014, p. 1, The Patent Office of the People's Republic of China, Beijing, China. English abstract submitted.

* cited by examiner

*Primary Examiner* — Brian Walck
(74) *Attorney, Agent, or Firm* — Jordan IP Law, LLC; Todd A. Vaughn

(57) ABSTRACT

A method for heat-treating a cast component composed of an aluminum base alloy, in which method the cast component is annealed at a predetermined annealing temperature for a predetermined annealing period in a first heat transfer medium and then transferred into a water bath. Between being annealed and transferred into the water bath, the cast component is transferred into a second heat transfer medium at a predetermined intermediate cooling temperature, where it is held for a predetermined intermediate cooling period.

15 Claims, 2 Drawing Sheets

METHOD FOR HEAT-TREATING A CAST COMPONENT

CROSS-REFERENCE TO RELATED APPLICATIONS

The present application is a National Stage Application of PCT International Application No. PCTEP2011/062471 (filed on Jul. 20, 2011), under 35 U.S.C. §371, which claims priority to German Patent Application No. DE 10 2010 031 612.1 (filed on Jul. 21, 2010) and German Patent Application No. DE 10 2010 061 895.0 (filed on Nov. 24, 2010), which are each hereby incorporated by reference in their respective entireties.

TECHNICAL FIELD

The invention relates to a method for heat-treating a cast component composed of an aluminum base alloy, in which method the cast component is annealed at a predetermined annealing temperature for a predetermined annealing period in a first heat transfer medium and then transferred into a water bath. Between being annealed and transferred into the water bath, the cast component is transferred into a second heat transfer medium at a predetermined intermediate cooling temperature, where it is held for a predetermined intermediate cooling period.

BACKGROUND

Generally, methods for heat-treating cast components are generally known in the prior art. When cast components made of aluminum base alloys are cooled after casting, an intermetallic phase is deposited in a matrix of solid solutions rich in aluminum. In the system AlMgSi, this is an $Mg_2Si$ phase, for example, which is embedded in an $\alpha$ solid solution matrix. This intermetallic phase has a disadvantageous effect on the hardness of the cast component.

To enhance the material properties, what is known as solution annealing is therefore carried out, in which the cast component is heated to a temperature above the saturation line but below the eutectic temperature, at which it is held for a predetermined time. During the solution annealing, the intermetallic phase precipitated in the solid solution rich in aluminum dissolves.

To prevent the intermetallic phases from precipitating again after the solution annealing, the component is usually quenched immediately after the annealing treatment. After quenching, age-hardening may also be effected.

SUMMARY

The present invention is based on an object of providing an enhanced method for heat-treating cast components.

This object is achieved by a method for heat-treating a cast component composed of an aluminum base alloy, the cast component being annealed at a predetermined annealing temperature for a predetermined annealing period in a first heat transfer medium and then transferred into a water bath. In accordance with the invention, it is provided that, between being annealed and transferred into the water bath, the cast component is transferred into a second heat transfer medium at a predetermined intermediate cooling temperature, where it is held for a predetermined intermediate cooling period.

Such a method makes it possible in particular to control the temperature management and the associated change in microstructure of the cast component as it is being cooled. A suitable choice of intermediate cooling temperature and period makes it possible, for example in the case of magnesium-containing aluminum alloys, to particularly effectively control the preliminary precipitation of the magnesium silicide ($Mg_2Si$).

The intermediate cooling temperature is preferably 150° C. to 380° C., and in particular 240° C. to 280° C. At this temperature, the previously dissolved magnesium silicide remains largely in solution and is therefore available in its entirety for the later age-hardening treatment. To this end, it is particularly expedient to select an intermediate cooling period of 3 sec to 10 min, in particular of 3 sec to 10 sec.

The use of such an intermediate cooling step is particularly advantageous when a particularly high cooling rate is achieved as the cast component is being held in the second heat transfer medium. Cooling rates of less than −40 K/sec, and in particular between −55 to −65 K/sec, are advantageous. This achieves particularly reliable freezing of the proportion dissolved in the annealing step.

In order to avoid undesirable changes in microstructure of the cast component as it is being transferred from the first heat transfer medium into the second heat transfer medium, it is particularly advantageous to carry out this transfer particularly quickly. The period for transferring the cast component from the first heat transfer medium and the second heat transfer medium preferably amounts to 0 sec to 15 sec. This can be achieved, for example, by adjacently arranged heat treatment apparatuses, with the cast component being transferred by a robot immediately and directly between the two heat transfer media, for example.

Irrespective of the time frame for transferring the cast component between the two heat transfer media, it must be ensured that a temperature of the cast component is held above a temperature of 450° C. as the cast component is being transferred from the first heat transfer medium and the second heat transfer medium. Fundamentally, the cast component should thus retain annealing temperature, such that a premature, uncontrolled change in microstructure does not occur.

It is particularly advantageous if the temperature of the cast component is held above a temperature of 420° C. as the cast component is being transferred from the first heat transfer medium and the second heat transfer medium. This temperature is still adequately different from the threshold temperature for the precipitation, and therefore it is possible to prevent this temperature threshold from being undershot given a suitable system design without the need for additional heating apparatuses in the region in which the cast component is transferred between the two heat transfer media. It goes without saying that, in the event of appropriately long transfer operations, it is also possible to provide such intermediate heating, which can be realized, for example, with radiant heaters in the region of transfer between the two heat transfer media.

The method outlined can also be combined with additional treatment steps. It is advantageous, for example, to transfer the cast component, before it is transferred into the water bath, into a third heat transfer medium at a predetermined age-hardening temperature, and to hold it there for a predetermined age-hardening period. Such a method thus combines annealing, for example a solution annealing step, with controlled cooling and with directly following age-hardening, and therefore a particularly short cycle time can be achieved with such a method. At the same time, the residual heat from the cast component, after it has been removed from the second heat transfer medium, is utilized for the age-hardening, and therefore such a method saves a particularly large amount of energy. The direct coupling of annealing and age-hardening additionally avoids undesirable changes in microstructure, which could occur if the cast component is stored intermediately for a relatively long time at room temperature.

The age-hardening temperature during this age-hardening step is preferably 220° C. to 300° C., and in particular 160° C. to 280° C. The age-hardening period is preferably fixed at a time of between 1 min and 30 min. Despite the short age-hardening times, material qualities comparable to those achieved with conventional age-hardening lasting for several hours can be achieved with such a method. This particularly quick method can therefore advantageously be integrated directly in die casting installations with short cycle times, without the need for logistically complicated intermediate storage or buffering of the cast components.

Since the temperature ranges for the intermediate cooling and the age-hardening overlap, it may be possible to dispense with age-hardening in a third heat transfer medium. The cast component is then instead held for the desired age-hardening period after intermediate cooling in the second heat transfer medium, such that the steps of intermediate cooling and hot age-hardening are combined into a single method step. This makes it possible to carry out the method in a particularly economical manner.

The annealing step of the method is preferably carried out as a solution annealing step, in which precipitated alloying elements dissolve into solid solutions of the cast component rich in aluminum and the eutectic silicon is formed. To this end, an annealing temperature of between 460° C. to 540° C., and in particular of 485° C. to 495° C., is chosen. The annealing period in this case amounts to between 10 sec to 10 min, in particular 1.5 min to 3 min and particularly preferably 2 min. It is particularly expedient to transfer the cast component into the first heat transfer medium immediately after removal from the mold, i.e., from the heat of casting. By dispensing with heating from room temperature, said particularly quick annealing times can be realized.

Moving air can be used as the first and/or second and/or third heat transfer medium, which is particularly simple in terms of apparatus. It is particularly expedient, however, to use salt baths for said heat transfer media. On account of their high heat capacity, salt baths make particularly quick heating and cooling of treated cast components possible. Since it is possible to dispense with long-term heating and cooling phases, the use of salt baths makes it possible to achieve a particularly high cycle rate for production plants which employ such methods. The salt additionally absorbs release agents used during the casting from the surface of the cast component, and therefore it is possible to dispense with additional cleaning steps. The particularly good surface quality thus achieved additionally enhances the weldability and the corrosion resistance of the cast components.

Since, within the context of the method outlined, the component is quenched in a water bath directly from the second or third heat transfer medium, salt which may still be adhering to the surface of the cast component cannot crystallize out, but instead still adheres in liquid form to the surface of the cast component at the time when it is being dipped into the water bath. The salt therefore dissolves immediately and particularly readily in the water of the water bath, and therefore it is possible to dispense with later cleaning of salt residues or a salt crust from the cast component.

A molten salt containing sodium nitrate and/or potassium nitrate and/or sodium nitrite is used with preference as the salt for the salt bath.

In order to achieve particularly good cleaning of adhering salt residues from the cast component, it is preferable to use a water bath at a temperature of between 40° C. to 60° C. The slightly elevated temperature of the water bath compared to room temperature ensures a particularly good solubility of the salt which still adheres to the cast component. The cleaning of salt residues from the cast component can additionally be enhanced by circulation of the water bath.

DRAWINGS

Hereinbelow, the invention and the embodiments thereof will be explained in more detail with reference to the drawing, in which.

DESCRIPTION

Figure 1:
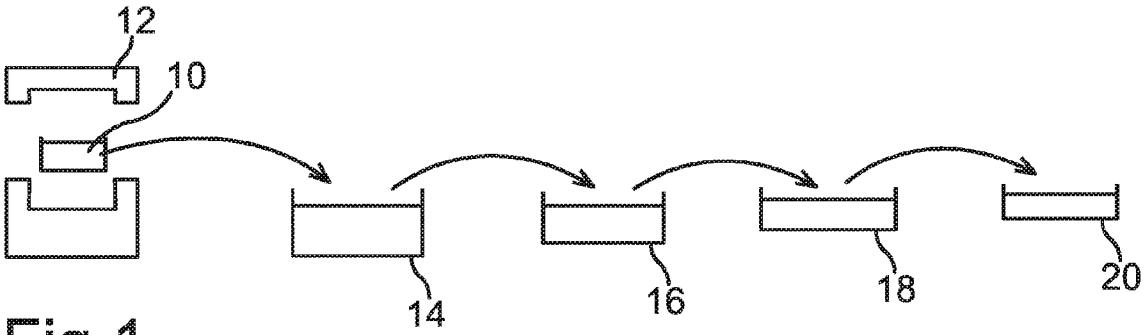
FIG. 1 is a schematic illustration of the sequence of an exemplary embodiment of the method in accordance with embodiments of the invention.
Figure 2:
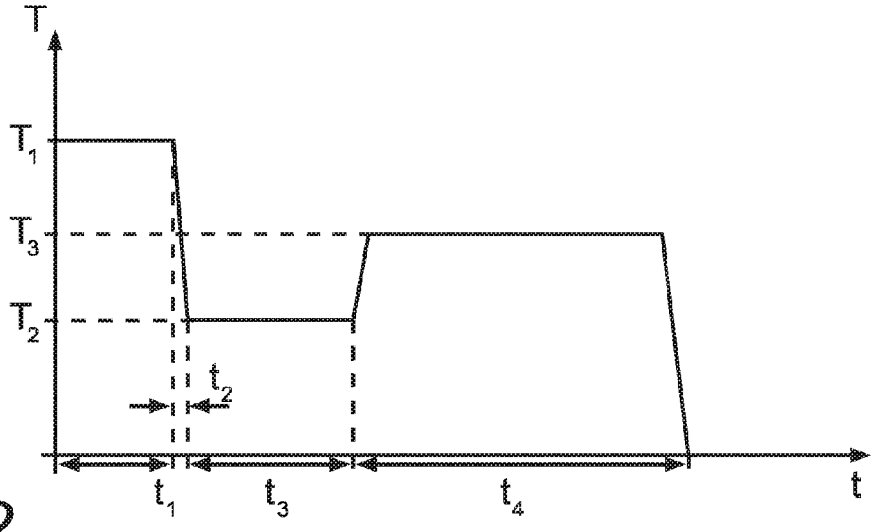
FIG. 2 is a graph illustrating the temperature profile as a method in accordance with embodiments of the invention is being carried out.

After a cast component 10 composed of an aluminum base alloy has been cast, it is removed from the casting mold 12 and transferred into a first salt bath 14. The salt bath 14 contains a melt of a mixture of alkali metal nitrates and nitrites at a first temperature $T_1$ of approximately 490° C. The cast component 10 is held in the first salt bath 14 for a first time $t_1$ of approximately 2 min. The treatment of the cast component 10 in the salt bath 14 corresponds to shock annealing, in which alloying elements dissolve in the solid solution rich in aluminum of the cast component 10. In order to achieve the desired effect, the temperature $T_1$ preferably has to lie above the saturation line of the metal mixture of the cast component 10, but always below the eutectic temperature $\theta_E$.

The molten salt in the salt bath 14 additionally dissolves release agents which are used during the casting and are bonded to the surface of the cast component 10. This cleaning effect enhances the surface quality of the cast component 10 and leads to enhanced weldability.

After the shock annealing of the cast component 10 in the salt bath 14, the cast component 10 is transferred into a second salt bath 16. This salt bath 16 also contains a melt of mixed alkali metal nitrates and nitrites, at a second temperature $T_2$ of which is approximately 180° C. In this case, it must be ensured that the cast component 10 is transferred between the first salt bath 14 and the second salt bath 16 over a short second period $t_2$ of no greater than 15 sec, in order to avoid excessive cooling of the cast component 10.

The temperature of the salt bath 16 is below the threshold temperature for the precipitation of the magnesium silicide in aluminum-silicon-magnesium alloys, which is approximately between 240° C. to 250° C. The proportion dissolved in the annealing step, i.e. during the treatment of the cast component 10 in the salt bath 14, is frozen by the rapid transfer and the holding in the second salt bath 16, and therefore, the precipitation of intermetallic phases, for example, $Al_2Cu$ or $Mg_2Si$, which usually sets in on account of the solubility of the solid solution rich in aluminum falling as the temperature drops, is prevented. On account of the good heat capacity of the molten salt, a cooling rate of approximately −60 K/sec can be achieved in the salt bath 16.

After a holding third time $t_3$ of 3 sec to 10 min in the salt bath 16, the cast component 10 is finally transferred into a further salt bath 18, where it is cooled or heated again to a third temperature $T_3$ of 160° C. to 280° C. and held for a fourth time $t_4$ of approximately 10 min. The treatment in the third salt bath 18 can in this respect replace age-hardening.

Instead of age-hardening in a third salt bath 18, the age-hardening can also be carried out after the intermediate cooling in the salt bath 16. After the third holding time $t_3$, the cast component 10 is then held in the salt bath 16 for a fourth period $t_4$. It is then possible to dispense with the third salt bath 18 entirely. After the age-hardening in the salt bath 16, the cast component 10 can be transferred directly into a water bath 20 for quenching.

The shock annealing and the short age-hardening fourth time $t_4$ thus make particularly quick heat treatment of the cast component 10 possible. As a result of the quick and direct transfer of the cast component 10 from the casting mold 12 into the first salt bath 14, or between the first salt bath 14, the second salt bath 16 and the third salt bath 18, it is additionally the case that no energy is lost by cooling of the cast component, and therefore, the method outlined is additionally particularly efficient in terms of energy.

After the age-hardening in the salt bath 18 has ended, the cast component 10 is finally transferred into a water bath 20 at a temperature of approximately 40° C. to 60° C. The transfer between the salt bath 18 and the water bath 20 also preferably takes place quickly, i.e., in a period of a few seconds, in order to prevent the molten salt from crystallizing out on the surface of the cast component 10. Since salt residues adhering to the cast component are thus transferred into the water bath 20 in molten form, the salt residues dissolve particularly readily, and therefore it is possible to dispense with additional cleaning of the cast component 10. By controlling the temperature of the water bath to 40° C. to 60° C., the dissolution of adhering salt is still promoted. An additional enhancement in the solubility of salt residues can be achieved by agitating the water bath 20.

The method is of course not restricted to the T6 annealing described above. Alternatively, it is also possible within the context of the invention, for example, for soft-annealing to be carried out, in which the cast component 10, after solution annealing, is quenched to a temperature of between 280° C. and 420° C., preferably between 300° C. and 380° C., at which it is held for 2 min to 20 min. This is followed immediately by quenching in the water bath 20.

What is thus provided overall is a method for heat-treating cast components 10 which is quick and energy-efficient and, on account of the short treatment times, minimizes instances of warpage of the cast components 10 to the greatest possible extent. After the treatment in the water bath 20, further mechanical treatment steps may follow, such as the removal of casting residues, deburring or straightening of the cast component. The short residence times of the cast component 10 in the first salt bath 14, the second salt bath 16, the third salt bath 18 and also in the water bath 20 make it possible to directly integrate the heat treatment in the casting process and to adapt the heat-treatment steps to the cycle times of the casting mold 12, and therefore, it is possible in addition to dispense with buffer furnaces, logistically complicated intermediate storage steps and the like.

In addition to the outlined three-stage treatment by solution annealing, intermediate cooling and age-hardening, a two-stage treatment of cast components is also possible, in which the age-hardening and the intermediate cooling are combined in a single step. The solution annealing is carried out here for a period of 2-4 minutes at a temperature of between 490° C.-510° C., preferably at 500° C. In this variant of the method, too, a salt bath 14 of the described type is preferably used for this purpose. Immediately after the solution annealing, the cast component 10 is transferred into a further salt bath 16, where it is likewise held for a time period of between 2-20 minutes, preferably 2-12 minutes, and particularly preferably 2-6 minutes, at a temperature of between 180° C. and 300° C., preferably between 220° C. and 300° C. A temperature of 240° C. to 280° C. is particularly expedient, in particular temperatures of 240° C. and 260° C. After this treatment step, the cast component 10 thus treated is again quenched in the water bath. In this way, it is possible to obtain the desired material properties of the cast component 10 particularly quickly.

The method described is suitable in principle for all die-cast alloys based on aluminum, in particular for aluminum-silicon alloys with a proportion of magnesium. For components having particularly high demands in respect of ductility, an alloy with the following composition can be used, for example: Silicon 9.5-11.5% by weight; Manganese 0.3-0.7% by weight; Iron 0.15-0.35% by weight; Magnesium 0.15-0.6% by weight; Titanium max. 0.1% by weight; Strontium 90-180 ppm by weight, and also optionally with: Chromium 0.1-0.3% by weight; Nickel 0.1-0.3% by weight; and Cobalt 0.1-0.3% by weight.

The remainder of the alloy consists here of aluminum with individually not more than 0.05% by weight and in total not more than 0.2% by weight unavoidable impurities.

Figure 3:
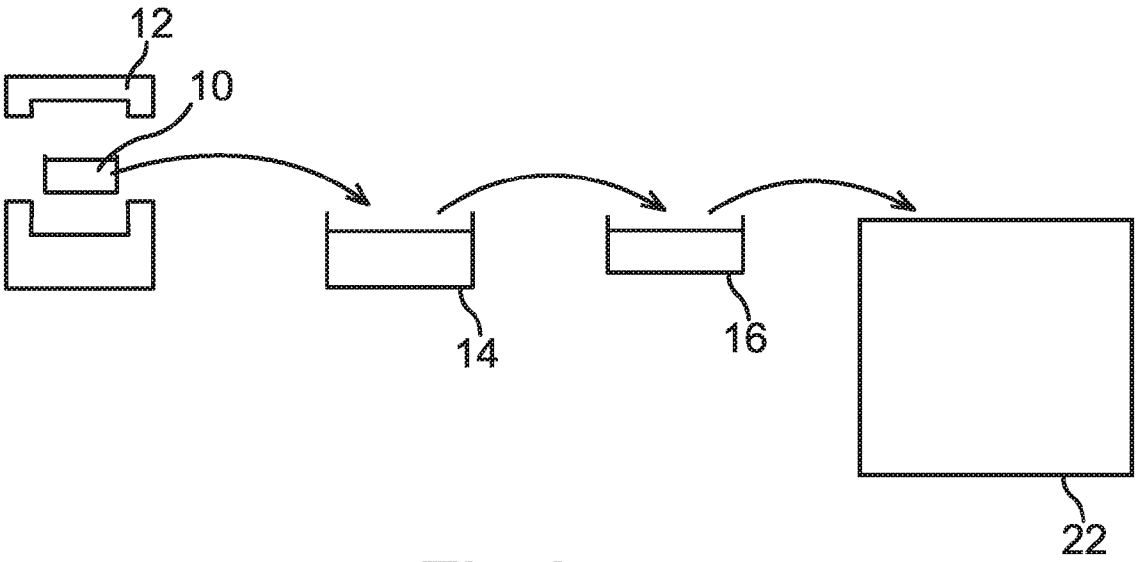
FIG. 3 is an alternative schematic illustration of the sequence of a further exemplary embodiment of the method in accordance with embodiments of the invention.

FIG. 3 illlustrates, in a schematic illustration, the sequence of a further exemplary embodiment of the method, in which, after it has been removed from the casting mold 12, firstly the cast component 10 is subjected to solution annealing in a salt bath 14. Analogously to the exemplary embodiment described in connection with FIG. 1, the salt bath 14 contains a melt of a mixture of alkali metal nitrates and nitrites at a temperature $T_1$ of approximately 510° C. The cast component 10 is held in the first salt bath 14 for a time $t_1$ of approximately 3 min.

After the cast component 10 has been subjected to solution annealing in the salt bath 14, it is transferred in turn into the further salt bath 16. This salt bath 16, too, contains a melt of mixed alkali metal nitrates and nitrites. In this case, it must be ensured that the cast component 10 is transferred between the salt baths 14 and 16 preferably over a short period $t_2$ of at most 15 s, in order to avoid excessive cooling of the cast component 10.

The temperature $T_2$ of the salt bath 16 here lies at approximately 240° C. to 280° C., and in particular at approximately 260° C. Since the cooling rate of the cast component 10 in the present case lies below −40 K per s, and in particular at −55 to −65 K per s, as it is being held in the second salt bath 16, quenching of the cast component 10 is already present here in the present case. In this respect, the cast component 10 is preferably held in the salt bath 16 for a holding time $t_3$ of 2 s to 30 s, and in particular approximately 10 s. The precipitation of $Mg_2Si$ is already prevented here by the short holding time.

Finally, the cast component 10 is transferred in turn into a water bath 20 preferably approximately at room temperature. The transfer between the salt bath 16 and the water bath 20 also preferably takes place quickly, i.e. in a period of a few seconds, in order to prevent the molten salt from crystallizing out on the surface of the cast component 10. In the present case, the water bath 20 therefore serves merely for cleaning and not for quenching the cast component 10, which has already been effected in the salt bath 16. Since salt residues adhering to the cast component 10 are thus transferred into the water bath 20 in molten form, the salt residues dissolve particularly readily, and therefore it is possible to dispense with additional cleaning of the cast component 10.

At this point, it should be mentioned that cleaning additives may be added to the water bath 20. In addition, it is to be considered as included within the framework of the invention that a multi-stage water bath 20 can be provided.

Finally, in the method described in FIG. 3, separate age-hardening takes place in an age-hardening device 22, which preferably comprises a heat-treatment furnace. In this case, for example, the cast component 10 is age-hardened in moving air at a temperature of 220° C. to 300° C., and in particular at approximately 260° C., over a period of 40 min to 60 min, and in particular approximately 50 min. Such age-hardening times produce a high ductility of the cast component 10.

The method described in the present case is suitable in particular for the alloy indicated above, but is not limited thereto.

What is claimed is:

1. A method for heat-treating a cast component composed of an aluminum base alloy, the method comprising:

annealing the cast component at a predetermined first temperature for a predetermined first time period in a first salt bath;

transferring, for no greater than 15 seconds, the annealed cast component from the first salt bath into a second salt bath, and maintaining, in parallel to the transferring, the temperature of the cast component above a temperature of 420° C.;

cooling the annealed cast component the annealed cast component in the second salt bath at a predetermined second temperature for a predetermined third time period;

age-hardening the cooled and annealed cast component by transferring the cooled and annealed cast component into a third salt bath at a predetermined third temperature for a predetermined fourth period; and quenching the age-hardened, cooled, and annealed cast component by transferring the age-hardened, cooled, and annealed cast component into a water bath.

2. A method for heat-treating a cast component composed of an aluminum base alloy, the method comprising:

annealing the cast component in a first water bath at a predetermined first temperature for a predetermined first time period;

transferring, in response to the annealing and for no greater than 15 seconds, the cast component from the first salt bath into a second salt bath, and maintaining, in parallel to the transferring, the temperature of the cast component above a temperature of 420° C.;

cooling, in response to the transferring, the cast component in the second salt bath at a predetermined second temperature for a predetermined second time period, wherein the predetermined second temperature is different than the predetermined first temperature;

age-hardening, in response to the cooling, the cast component by transferring the cast component into a third salt bath at a predetermined third temperature for a predetermined fourth period, wherein the predetermined third temperature is different than the predetermined first temperature; and quenching, in response to age-hardening, the cast component by transferring the cast component into a water bath.

3. The method of claim 2, wherein the predetermined second temperature is in a range of between 150° C. to 380° C.

4. The method of claim 2, wherein the predetermined second temperature is in a range of between 240° C. to 280° C.

5. The method of claim 2, wherein the predetermined second time period is in a range of between 3 sec to 10 min.

6. The method of claim 2, wherein the predetermined second time period is in a range of between 3 sec to 10 s.

7. The method of claim 2, wherein a cooling rate of the cast component while in the second salt water bath is less than −40 K/sec.

8. The method of claim 2, wherein a cooling rate of the cast component while in the second salt bath is less than a range of between −55 to −65 K/sec.

9. The method of claim 2, wherein the predetermined third temperature is in a range of between 220° C. to 300° C.

10. The method of claim 2, wherein the predetermined third temperature is in a range of between 160° C. to 280° C.

11. The method of claim 2, wherein the predetermined first temperature is in a range of between 460° C. to 540° C.

12. The method of claim 2, wherein the predetermined first time period is in a range of between 10 sec to 10 min.

13. The method of claim 2, wherein the predetermined first time period is in a range of between 1.5 min to 3 min.

14. The method of claim 2, wherein the first salt bath, the second salt bath, and the third salt bath each comprises a molten salt containing sodium nitrate.

15. A method for heat-treating a cast component, the method comprising:

annealing, in a first salt bath, a cast component composed of an aluminum base alloy, at a predetermined first temperature for a predetermined first time period;

transferring, in response to the annealing and between a second predetermined time period, the cast component from the first salt bath into a second salt bath;

maintaining, in parallel to the transferring, the temperature of the cast component above a temperature of 420° C.;

cooling, in response to the annealing and transferring, the cast component in the second salt bath at a predetermined second temperature for a predetermined third time period;

age-hardening, in response to the cooling, the cast component in a third salt bath at a predetermined third temperature for a predetermined fourth period; and quenching, in response to the age-hardening, the cast component into a water bath.

* * * * *